US006024581A

United States Patent [19]

Barnett et al.

[11] Patent Number: 6,024,581

[45] Date of Patent: Feb. 15, 2000

[54] ELECTRICAL SOCKET FOR A MULTICHIP MODULE

[75] Inventors: David M. Barnett; Daniel R. Morgenthaler, both of Littleton, Colo.

[73] Assignee: Lockheed Martin Corporation, Bethesda, Md.

[21] Appl. No.: 08/778,868

[22] Filed: Jan. 2, 1997

[51] Int. Cl.[7] ..... H01R 9/09

[52] U.S. Cl. ..... 439/72; 439/862; 439/331

[58] Field of Search ..... 439/70, 72, 73, 439/68, 331, 525, 526, 862, 660

[56] References Cited

U.S. PATENT DOCUMENTS

| | | | |
|---|---|---|---|
| 3,297,974 | 1/1967 | Pittman | 439/331 |
| 4,026,412 | 5/1977 | Henson | 439/68 |
| 4,737,118 | 4/1988 | Lockard | 439/660 |
| 5,221,209 | 6/1993 | D'Amico . | |
| 5,315,486 | 5/1994 | Fillion et al. . | |
| 5,347,091 | 9/1994 | Schroder . | |
| 5,380,225 | 1/1995 | Inaoka | 439/660 |
| 5,451,818 | 9/1995 | Chan et al. . | |
| 5,455,390 | 10/1995 | DiStefano et al. . | |
| 5,465,470 | 11/1995 | Vongfuangfoo et al. . | |
| 5,468,158 | 11/1995 | Roebuck et al. . | |
| 5,468,996 | 11/1995 | Chan et al. . | |

FOREIGN PATENT DOCUMENTS

| | | | |
|---|---|---|---|
| 1545273 | 2/1990 | U.S.S.R. | 439/862 |
| 1582234 | 7/1990 | U.S.S.R. | 439/862 |

*Primary Examiner*—Paula Bradley
*Assistant Examiner*—Tho Dac Ta
*Attorney, Agent, or Firm*—Holme Robert & Owen LLP; Edwin H. Crabtree

[57] ABSTRACT

An electrical socket used for interconnecting a multichip module to a printed circuit board or similar electrical system. The electrical socket is independent of the multichip module and permits removal and replacement of the multichip module without damaging the module and its module electrical leads. The socket includes an insulated base strip and an insulated cap strip. The base strip includes a plurality of elongated lower pockets therein for receiving and properly aligning each of the module electrical leads therein. The base strip also includes conductive pads in the bottom of and along the length of each pocket. Each conductive pad is connected to a socket lead. The socket leads are used for connection to the printed circuit board or like electrical system. The cap strip includes a plurality of elongated upper pockets therein which are dimensioned for receipt above the lower pockets of the base strip. The module electrical leads are curved sinusoidally so that when the cap strip is received on top of the base strip, the module electrical leads are compressed inside the upper and lower pockets. The compliance of the leads inside the electrical socket provides for maintaining good electrical contact during various environmental stresses such as temperature fluctuations and vibrations found during aircraft and spacecraft flight.

13 Claims, 3 Drawing Sheets

ELECTRICAL SOCKET FOR A MULTICHIP MODULE

BACKGROUND OF THE INVENTION (a) Field of the Invention

This invention relates generally to electrical connectors and more particularly, but not by way of limitation, to interconnects between leaded multichip modules and circuit boards.

(b) Discussion of Prior Art

Heretofore multichip modules are routinely soldered in place to form electrical connections regardless of the lead style on the case. If a part has to be removed, the solder is reheated and the module is removed when the solder is liquid. This frequently results in the multichip module becoming damaged and being discarded. The subject invention described herein permits removal and reuse of the multichip module without damage or degradation.

Multichip module sockets do exist at this time, but they are designed for test-station usage and laboratory usage. These type of sockets are frequently much larger than the multichip module itself thus making them impractical for installation in electronic packaging for end users. Also, the existing sockets are unsuited for providing good thermal paths through the base of the multichip module package and generally rely on convective cooling.

In U.S. Pat. No. 5,468,158 to Roebuck et al. and U.S. Pat. No. 5,221,209 to D'Amico different types of MCM leadless interconnect systems with sockets are described having a plurality of conductors. U.S. Pat. No. 5,451,818 to Chan et al. discloses the use of a ceramic package for covering a series of layers such as a solid conductive layer and a dielectric layer covering transmission lines. U.S. Pat. No. 5,347,091 to Schroder describes the use of low temperature co-fired ceramic laminates in the form of a circuit card for interconnecting multi-chip modules to each other electrically. In U.S. Pat. No. 5,315,486 to Fillion et al. a high density interconnect system is disclosed and having a ceramic base used for forming a hermetic package. U.S. Pat. No. 5,468,996 to Chan et al., U.S. Pat. No. 5,455,390 to DiStefano et al. and U.S. Pat. No. 5,465,470 to Vongfuangfoo et al. describe different types of MCM packaging and apparatus for mounting and bonding multiple leads.

None of the above mentioned patents disclose the unique features, structure and advantages of the subject electrical socket for leaded multichip modules and interconnecting modules to printed circuit boards and the like.

SUMMARY OF THE INVENTION

In view of the foregoing, it is a primary object of the present invention to provide an electrical socket which permits removal and reuse of a multichip module without damage or degradation to the module.

Another object of the invention is to provide a very small socket, when compared to presently available sockets, which is suitable for installation in electronic assemblies that may have to meet very strenuous environmental requirements such as aircraft or spacecraft. Further, the electrical socket does not extend under the multichip module thereby allowing good thermal contact between the multichip module and the mounting substrate which is critical for demanding applications.

Still another object of the invention is the subject electrical socket overcomes the limitations of the prior art sockets by using miniature insulated base strips and insulated cap strips clamped to the multichip module leads in a conductive assembly and routing electrical signals to a secondary set of leads. The resulting size and durability of the subject interconnect system makes it suitable for mass production and use in demanding applications.

Yet another object of the invention is the socket allows for proper lead alignment and preserves alignment during final clamping. The socket may be fabricated in a variety of materials including plastics and ceramics and can be molded or machine-processed.

The subject invention includes an insulated base strip and an insulated cap strip. The base strip includes a plurality of elongated lower pockets therein for receiving and properly aligning each of the module electrical leads therein. The base strip also includes conductive pads in the bottom of and along the length of each pocket. Each conductive pad is connected to a socket lead. The socket leads are used for connection to the printed circuit board or like electrical system. The cap strip includes a plurality of elongated upper pockets therein which are dimensioned for receipt above the lower pockets of the base strip. The module electrical leads are curved sinusoidally so that when the cap strip is received on top of the base strip, the module electrical leads are compressed inside the upper and lower pockets. The compliance of the leads inside the electrical socket provides for maintaining good electrical contact during various environmental stresses such as temperature fluctuations and vibrations found during aircraft and spacecraft flight.

These and other objects of the present invention will become apparent to those familiar with multichip modules and circuit board interconnect systems when reviewing the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
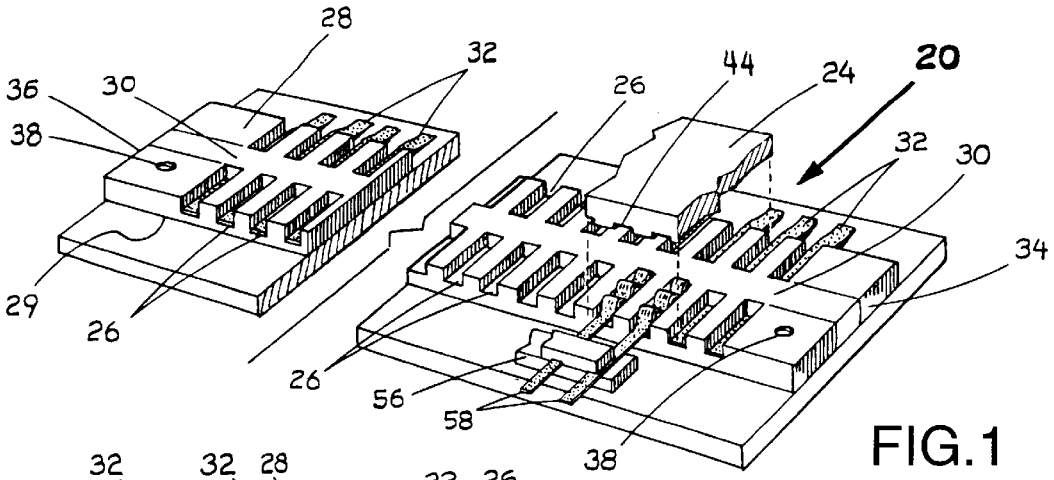
FIG. 1 is a perspective view of the insulated base strip having a plurality of parallel lower pockets formed therein.
Figure 2:
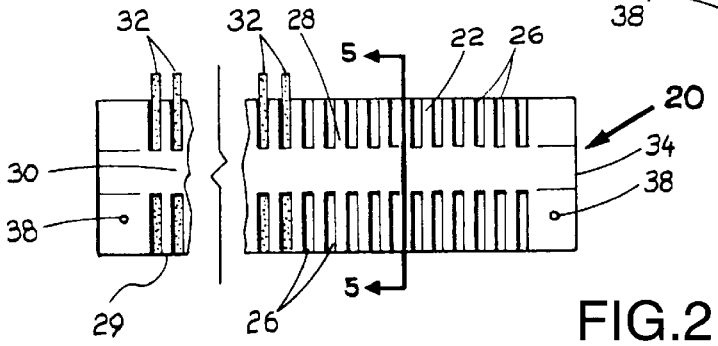
FIG. 2 is a top view of the insulated base strip.

Referring to both FIG. 1 and FIG. 2, a perspective view and a top view of an insulated base strip 22 is shown which forms part of the electrical socket having general reference numeral 20. The electrical socket 20 also includes an insulated cap strip 24 shown in FIGS. 3 and 4. The base strip 22 includes a plurality of elongated lower pockets 26 formed in a top 28 and across the width of the base strip 22. Also, the base strip 22 has a bottom 29. The base strip 22 includes a cross bar 30 disposed along the length of the base strip 22 for providing additional strength thereto. Disposed and formed in the bottom of the lower pockets 26 are outwardly extending socket leads 32 which are used for electrical connection to a printed circuit board or similar electrical system. Only a few of the socket leads 32 are shown in this drawing. The base strip 22 also includes opposite ends 34 and 36 having fastener holes 38 therein for receiving a fastener in securing the cap strip 24 on top of the base strip 22. A fastener, such as a threaded screw and the like, may be used with the fastener holes 38. The fastener is not shown in the drawings. The fastener holes 38 are optional and an external clamp system or like fastening means may be used in the alternative.

Figure 3:
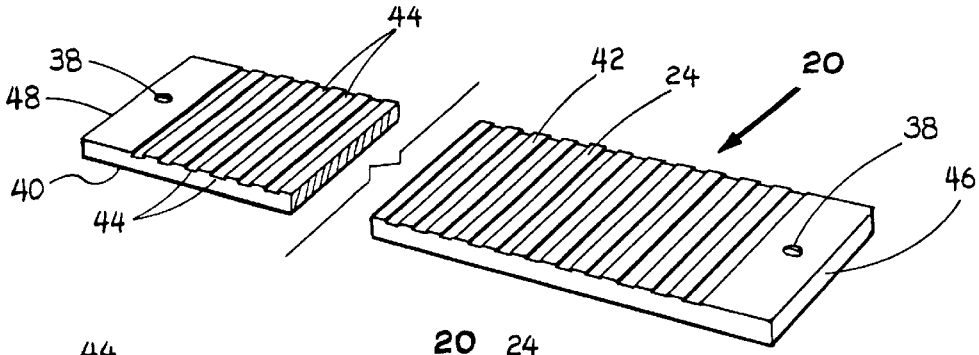
FIG. 3 is a perspective view of the insulated cap strip having a plurality of parallel upper pockets formed therein.
Figure 4:
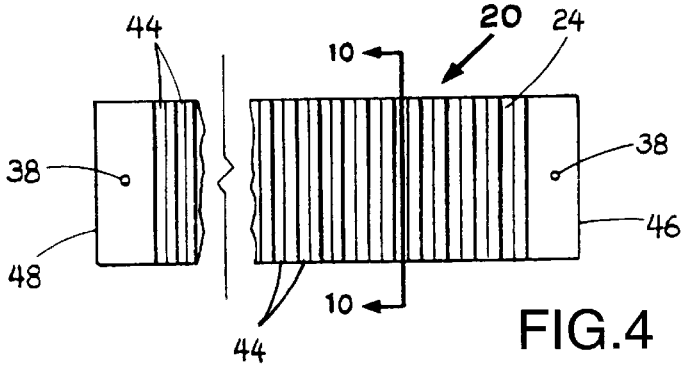
FIG. 4 is a bottom view of the insulated base strip.

Referring now to both FIG. 3 and FIG. 4, a perspective view and a bottom view of an insulated cap strip 24 is shown. The cap strip 24 is shown upside down in FIG. 3 and includes a top 40 and a bottom 42. A plurality of elongated upper pockets 44 are formed in the bottom 42 and across the width of the cap strip 24. The cap strip 24 also includes opposite ends 46 and 48 having fastener holes 38 therein.

Figure 5:
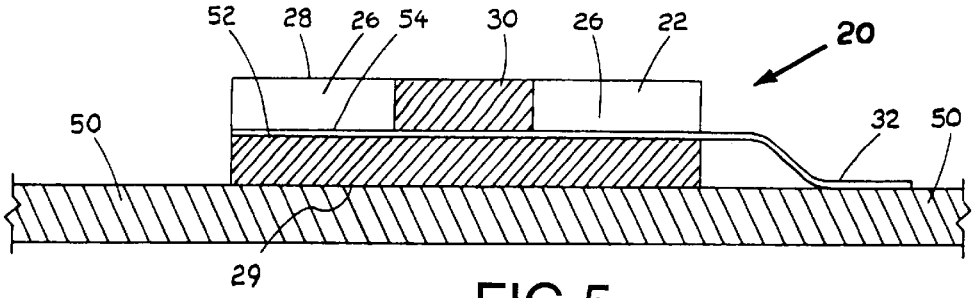
FIG. 5 is a sectional view of the base strip taken along lines 5—5 shown in FIG. 2. The base strip is shown mounted on top of a substrate. Please note that FIGS. 5–10 are enlarged views of the subject electrical socket for disclosing in greater detail the elements making of the socket.
Figure 6:
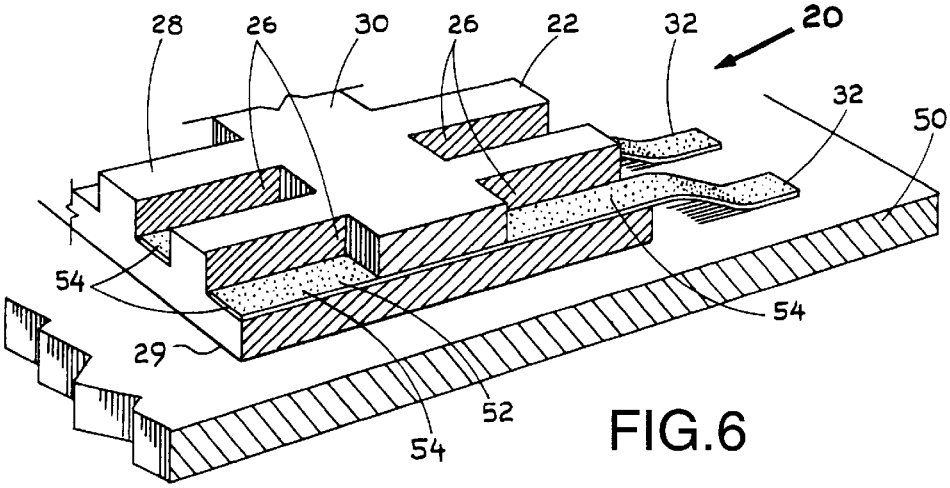
FIG. 6 is a perspective view of the base strip as shown in FIG. 5 and illustrating the lower pockets with conductive pads and socket leads.

In FIG. 5, a sectional view of the base strip 22 is shown taken along lines 5—5 in FIG. 2. In this view, the base strip 22 is shown mounted on top of a substrate 50. In a bottom 52 of the lower pockets 26 and along the length of the pockets 26 is a conductive pad 54 which is connected to the socket lead 32. In FIG. 6, a perspective view of a portion of the base strip 22 is shown with the parallel lower pockets 26 having the conductive pads 54 running the length of the pockets 26 and connected to the socket leads 32. It should be noted that both the base strip 22 and the cap strip 24 may be injected molded or fabricated using insulating material such as plastic, co-fired ceramic, alumina ceramic and like materials.

Figure 7:
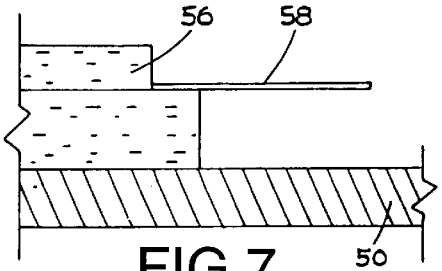
FIG. 7 is a sectional view of a portion of the substrate with a side view of a multichip module mounted thereon.

In FIG. 7, a sectional view of a portion of the substrate 50 is shown with a side view of a multichip module 56 mounted thereon. The module 56 includes a module electrical lead 58 extending outwardly therefrom for transmitting electrical signals. While a single lead 58 is shown in the drawings, it should be kept in mind that a plurality of module electrical leads 58 may extent outwardly from all sides of the module 56. In this case, a number of electrical sockets 20 would be used to interface with the different sides of the module 56 and properly engage the leads 58 to transmit and receive electrical signals from printed circuit boards and the like.

Figure 8:
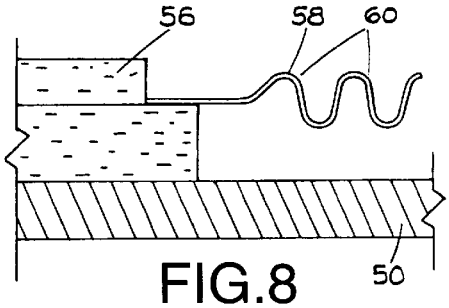
FIG. 8 is a side view of the multichip module with a module electrical lead curved sinusoidally.
Figure 9:
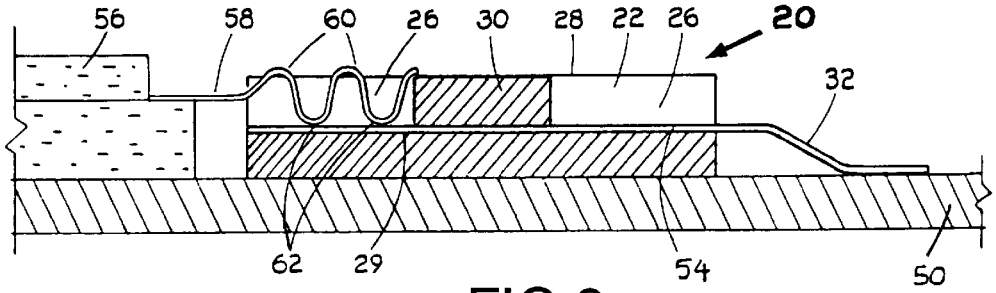
FIG. 9 is similar to FIG. 5 and FIG. 8 with the sinusoidal electrical lead disposed along the length of a lower pocket in the base strip.
Figure 10:
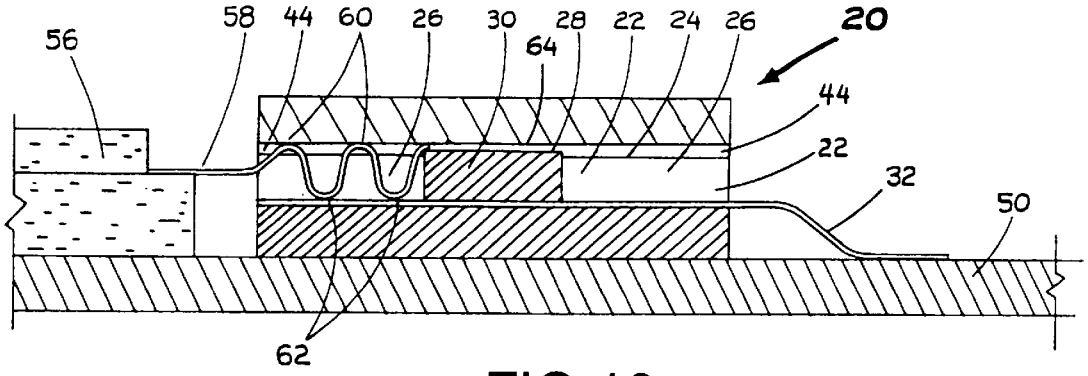
FIG. 10 is similar to FIG. 9 with the cap strip received on top of the base strip and the sinusoidal electrical lead compressed inside the upper and lower pockets of the cap strip and base strip.

In FIG. 8, the module electrical lead 58 is shown curved into a sinusoidal configuration 60. This curved configuration 60 provides a real benefit when the lead 58 is connected to the electrical socket 20 in that the lead 58 is "spring-like" and therefore is able to withstand vibrations and temperature fluctuations while still maintaining good multi-point electrical contacts 62 with the conductive pad 54. The multi-point electrical contacts 62 are shown in FIGS. 9 and 10. While the sinusoidal configuration 60 is shown and discussed herein, it should be appreciated that the lead 58 can be curved into various types of configurations for accomplishing the same results and without departing from the spirit and scope of the invention as disclosed.

In FIG. 9, the base strip 22 on the substrate 50 is shown mounted next to the multichip module 56. In this view, the module electrical lead 58 is received in one of the lower pockets 26 with the multi-point contacts 62 of the sinusoidal configuration 60 resting on top of the conductive pad 54. The top of the sinusoidal configuration 60 extends above the top 28 of the base strip 22. It should be noted when viewing this drawing and FIG. 6, the width of each lower pocket 26 and also the upper pockets 44 provide for proper alignment when the module electrical leads 58 are inserted into the lower pockets 26 and the upper pockets 44 are indexed on top of the lower pockets 26.

In FIG. 10, a cross section of the cap strip 24 is shown and taken along lines 10—10 as shown in FIG. 4. In this view, the cap strip 24 is received on top of the base strip 22 and secured with some type of fastener using the fastener holes 38. As mentioned above, the width of the lower pockets 26 and the upper pockets 44 help in the proper alignment of the module electrical leads received in the electrical socket 20. Also, when an upper portion of the sinusoidal configuration 60 of the lead 58 is engaged by a bottom 64 of the upper pocket 44, the lead 58 is compressed inside the two pockets 26 and 44. For example, the lead 58 may be compressed in a range of 20 to 40% which helps maintain the good multi-point contacts 62 with the conductive pad 54 and in turn enables the electrical socket to be able to withstand vibration, temperature fluctuations and environmental changes. This feature helps insure that there is no interruption of electrical signals between the multichip module 56 and the printed circuit board or like electrical system.

Figure 11:
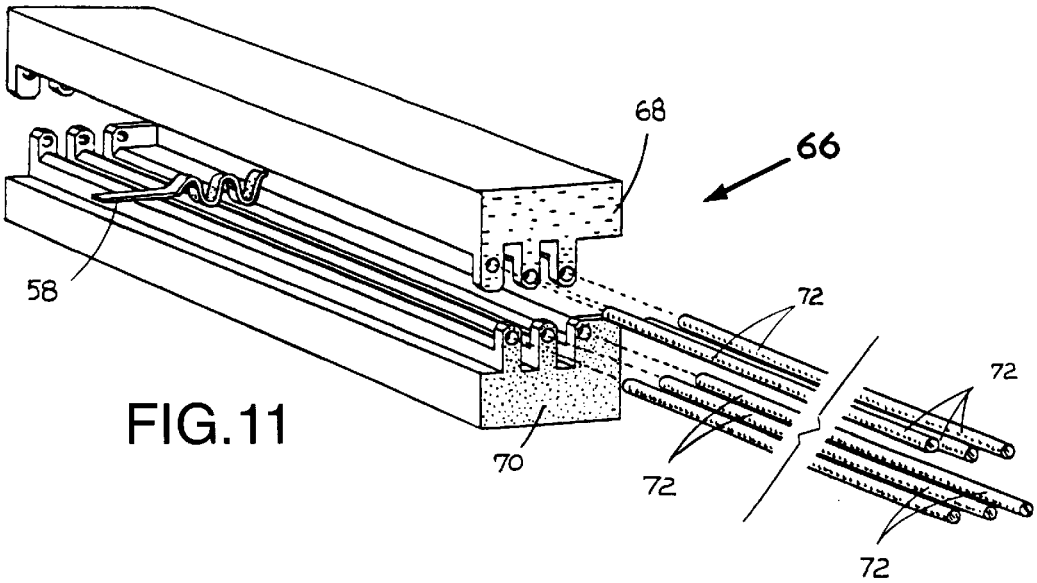
FIG. 11 is a perspective view of a pin shaping tool and pins used for curving the sinusoidal electrical lead.
Figure 12:
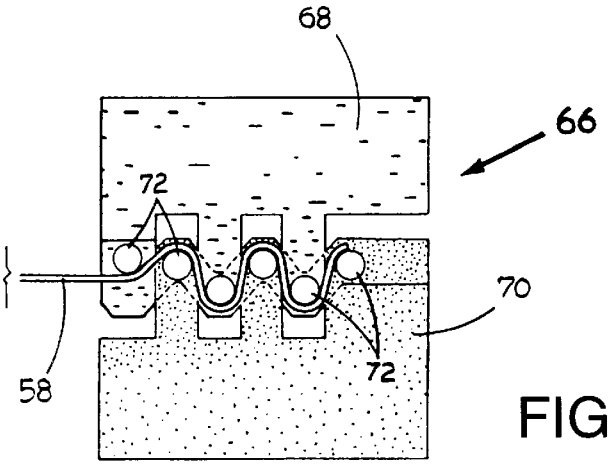
FIG. 12 is an end view of the pin shaping tool used for forming the multichip module lead.

In FIG. 11, a perspective view of a pin shaping tool having general reference numeral 66 is illustrated. The tool 66 includes a pin holding upper member 68 and a pin holding lower member 70. The upper member 68 and lower member 70 receive a plurality of spaced apart pins 72 thereon. When the upper member 68 is lowered on top of the lower member 68, the pins 72 engage both sides of the module electrical lead 58 placed therebetween and form the lead 58 into a sinusoidal configuration 60. FIG. 12 illustrates an end view of the pin shaping tool 66 with the lead 58 formed into a sinusoid by the pins 72. While the pin shaping tool 66 is shown in the drawings, it can be appreciated that various types of shaping tools can be used equally well for forming different configurations in the module electrical lead 58.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. An electrical socket used for interconnecting a multichip module to a printed circuit board or electrical system, the electrical socket is independent of the multichip module and permits removal and replacement of the multichip module without damaging the module and its module electrical leads, the module electrical leads each having a lower "U" shaped curved portion and an upper inverted "U" shaped curved portion, the socket comprising:

an insulated base strip, said base strip having a plurality of parallel elongated lower pockets adapted for receiving and properly aligning each of the module electrical leads therein, said base strip having conductive pads in a bottom of and along a length of each of said lower pockets, said conductive pads adapted for receiving the lower "U" shaped curved portion of the electrical leads thereagainst;

an insulated cap strip, said cap strip having a plurality of parallel elongated upper pockets, said upper pockets dimensioned for receipt on top of and indexed with said lower pockets of said base strip when said cap strip is secured to a top of said base strip, said upper pockets having a bottom therein, the bottom of said upper pockets adapted for receiving the upper inverted "U" shaped curved portion of the electrical leads thereagainst; and a distance between the bottom of said lower pockets of said base strip and the bottom of said upper pockets of said cap strip when said cap strip is secured to said base strip being "less" than a distance from a bottom of the lower "U" shaped curved portion of the electrical leads and a top of the upper inverted "U" shaped curved portion of the electrical leads in undeformed state thereof;

whereby the electrical leads are held in compression when received inside the socket for maintaining electrical continuity despite temperature fluctuations, vibration and shock environment during aircraft and spacecraft flight.

2. The socket as described in claim 1 wherein the distance between the bottom of said lower pockets of said base strip and the bottom of said upper pockets of said cap strip, when said cap strip is secured to said base strip, is in a range of 20 to 40 percent "less" than a distance from a bottom of the lower "U" shaped curved portion of the electrical leads and a top of the upper inverted "U" shaped curved portion of the electrical leads in the undeformed state thereof, for accordingly compressing the electrical leads 20 to 40 percent to help maintain good electrical contact.

3. The socket as described in claim 1 wherein the length of said conductive pads in the bottom of said lower pockets of said base strip is sufficient for receiving a plurality of lower "U" shaped curved portions of each electrical lead thereby providing multi-point electrical contact when the electrical leads are compressed inside the socket.

4. The socket as described in claim 1 wherein said conductive pads are connected to socket leads, said socket leads adapted for connection to the printed circuit board.

5. An electrical socket used for interconnecting a multichip module to a printed circuit board or electrical system, the electrical socket is independent of the multichip module and permits removal and replacement of the multichip module without damaging the module and its module electrical leads, the module electrical leads each having a sinusoidal configuration with a lower "U" shaped curved portion and an upper inverted "U" shaped curved portion, the socket comprising:

an insulated base strip, said base strip having a plurality of parallel elongated lower pockets adapted for receiving and properly aligning each of the module electrical leads therein, said base strip having conductive pads in a bottom of and along a length of each of said lower pockets, said conductive pads connected to socket leads, said socket leads adapted for connection to the printed circuit board, said conductive pads adapted for receiving the lower "U" shaped curved portion of the sinusoidal electrical leads thereagainst;

an insulated cap strip, said cap strip having a plurality of parallel elongated upper pockets, said upper pockets dimensioned for receipt on top of and indexed with said lower pockets of said base strip when said cap strip is secured to a top of said base strip, said upper pockets having a bottom therein, the bottom of said upper pockets adapted for receiving the upper inverted "U" shaped curved portion of the sinusoidal electrical leads thereagainst; and a distance between the bottom of said lower pockets of said base strip and the bottom of said upper pockets of said cap strip when said cap strip is secured to said base strip being "less" than a distance from a bottom of the lower "U" shaped curved portion of the electrical leads and a top of the upper inverted "U" shaped curved portion of the electrical leads in undeformed state thereof;

whereby the electrical leads are held in compression when received inside the socket for maintaining electrical continuity despite temperature fluctuations, vibration and shock environment during aircraft and spacecraft flight.

6. The socket as described in claim 5 wherein the distance between the bottom of said lower pockets of said base strip and the bottom of said upper pockets of said cap strip, when said cap strip is secured to said base strip, is in a range of 20 to 40 percent "less" than a distance from a bottom of the lower "U" shaped curved portion of the electrical leads and a top of the upper inverted "U" shaped curved portion of the electrical leads in the undeformed state thereof for accordingly compressing the electrical leads 20 to 40 percent to help maintain good electrical contact.

7. The socket as described in claim 5 wherein the length of said conductive pads in the bottom of said lower pockets of said base strip is sufficient for receiving a plurality of lower "U" shaped curved portions of each electrical lead thereby providing multi-point electrical contact when the electrical leads are compressed inside the socket.

8. A method of interconnecting a multichip module to a printed circuit board or electrical system using an electrical socket, the electrical socket is independent of the multichip module and permits removal and replacement of the multichip module without damaging the module and its multichip module electrical leads, the module electrical leads each having a lower "U" shaped curved portion and an upper inverted "U" shaped curved portion, the method of interconnecting comprising:

receiving and properly aligning the lower "U" shaped curved portion of the module electrical leads in a plurality of parallel elongated lower pockets in ah insulated base strip, the base strip having conductive pads in the bottom of and along the length of each lower pocket, a bottom of the lower "U" shaped curved portion of the module electrical leads disposed against the conductive pads;

receiving and properly aligning the upper inverted "U" shaped curved portion of the module electrical leads in a plurality of parallel elongated upper pockets in an insulated cap strip, a top of the inverted "U" shaped curved portion of the module electrical leads disposed against a bottom of the upper pockets, the upper pockets dimensioned for receipt above and indexing with the lower pockets of said base strip, a distance between the bottom of said lower pockets of said base strip and the bottom of said upper pockets of said cap strip when said cap strip is secured to said base strip being "less" than a distance from a bottom of the lower "U" shaped curved portion of the electrical leads and a top of the upper inverted "U" shaped curved portion of the electrical leads in undeformed state thereof; and compressing the module electrical leads inside the upper and lower pockets and providing a multi-point contact of the leads on the conductive pads.

9. The method as described in claim 8 wherein the distance between the bottom of said lower pockets of said base strip and the bottom of said upper pockets of said cap strip, when said cap strip is secured to said base strip, is in a range of 20 to 40 percent "less" than a distance from a bottom of the lower "U" shaped curved portion of the electrical leads and a top of the upper inverted "U" shaped curved portion of the electrical leads in the undeformed state thereof for accordingly compressing the electrical leads 20 to 40 percent to help maintain good electrical contact.

10. The method as described in claim 8 wherein the length of said conductive pads in the bottom of said lower pockets of said base strip is sufficient for receiving a plurality of lower "U" shaped curved portions of each electrical lead thereby providing multi-point electrical contact when the electrical leads are compressed inside the socket.

11. The method as described in claim 8 wherein said conductive pads are connected to socket leads, said socket leads adapted for connection to the printed circuit board.

12. The method as described in claim 8 further including the step of securing the cap strip on top of the base strip after compressing the module electrical leads inside the upper and lower pockets.

13. The method as described in claim 8 wherein the module electrical leads are curved into a sinusoidal configuration for providing the multi-point contact on the conductive pads.

* * * * *